United States Patent [19]

Lindee et al.

[11] 4,428,263

[45] Jan. 31, 1984

[54] FOOD LOAF SLICING MACHINE

[75] Inventors: Scott A. Lindee, New Lenox; Glenn A. Sandberg, Lockport, both of Ill.

[73] Assignee: Formax, Inc., Mokena, Ill.

[21] Appl. No.: 309,699

[22] Filed: Oct. 8, 1981

[51] Int. Cl.[3] ..... B26D 1/18; B26D 3/22

[52] U.S. Cl. ..... 83/354; 83/355; 83/367; 83/380; 83/390; 83/399; 83/440.1; 83/422; 83/444; 83/446; 83/449; 83/465; 83/580; 83/592

[58] Field of Search ..... 83/354, 355, 329, 592, 83/356.3, 356.1, 367, 380, 390, 399, 422, 440.1, 444, 446, 449, 465, 580

[56] References Cited

U.S. PATENT DOCUMENTS

| | | | |
|---|---|---|---|
| 2,692,645 | 10/1954 | Driesch | 83/355 |
| 2,752,968 | 7/1956 | Toby et al. . | |
| 2,768,666 | 10/1956 | Garapolo et al. . | |
| 2,966,186 | 12/1960 | Garapolo . | |
| 3,105,533 | 10/1963 | Hensgen et al. . | |
| 3,144,893 | 8/1964 | Dahms . | |
| 3,162,226 | 12/1964 | Toby et al. . | |
| 3,310,087 | 3/1967 | Werder et al. . | |
| 3,353,430 | 11/1967 | Brackmann et al. | 83/355 X |
| 3,358,724 | 12/1967 | Toby . | |
| 3,491,637 | 1/1970 | Hasten et al. | 83/355 X |
| 3,824,885 | 7/1974 | Marshall et al. . | |
| 3,855,889 | 12/1974 | Wiley et al. | 83/355 X |
| 3,880,035 | 4/1975 | Divan . | |
| 4,015,494 | 4/1977 | Spooner et al. . | |
| 4,041,813 | 8/1977 | Spencer | 83/329 X |
| 4,177,703 | 12/1979 | Cavier et al. | 83/356.3 |
| 4,271,740 | 6/1981 | Yamazaki et al. | 83/592 |

*Primary Examiner*—Frank T. Yost

*Attorney, Agent, or Firm*—Kinzer, Plyer, Dorn & McEachran

[57] ABSTRACT

A high volume food load slicing machine comprising a pair of loaf feed belt conveyors that continuously advance a food loaf along a downwardly inclined path through a collar into a slicing station at which a rotating and orbiting knife slices the load includes a variable speed knife rotation drive independent of the main drive that orbits the knife and drives the loaf conveyors. A hydrostatic speed variator in the drive connection for the conveyors, with speed corrections made by a stepper motor, affords precision control of slice thickness. A split collar and associated sensor afford continuous sensing of the loaf cross section to provide effective slice thickness correction; the collar is of molded machinable resin so that the knife can cut a working surface on the collar to a precise contour. The collar includes vacuum means to hold the butt end of a loaf for slicing.

21 Claims, 9 Drawing Figures

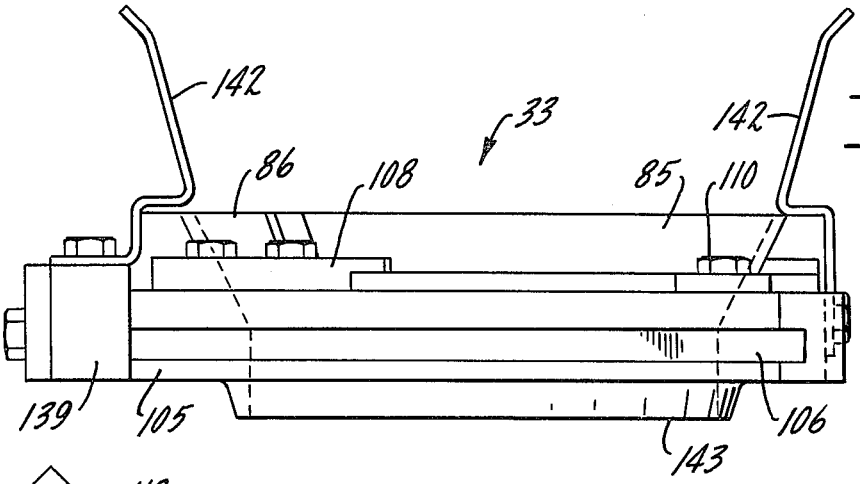
Fig. 5.
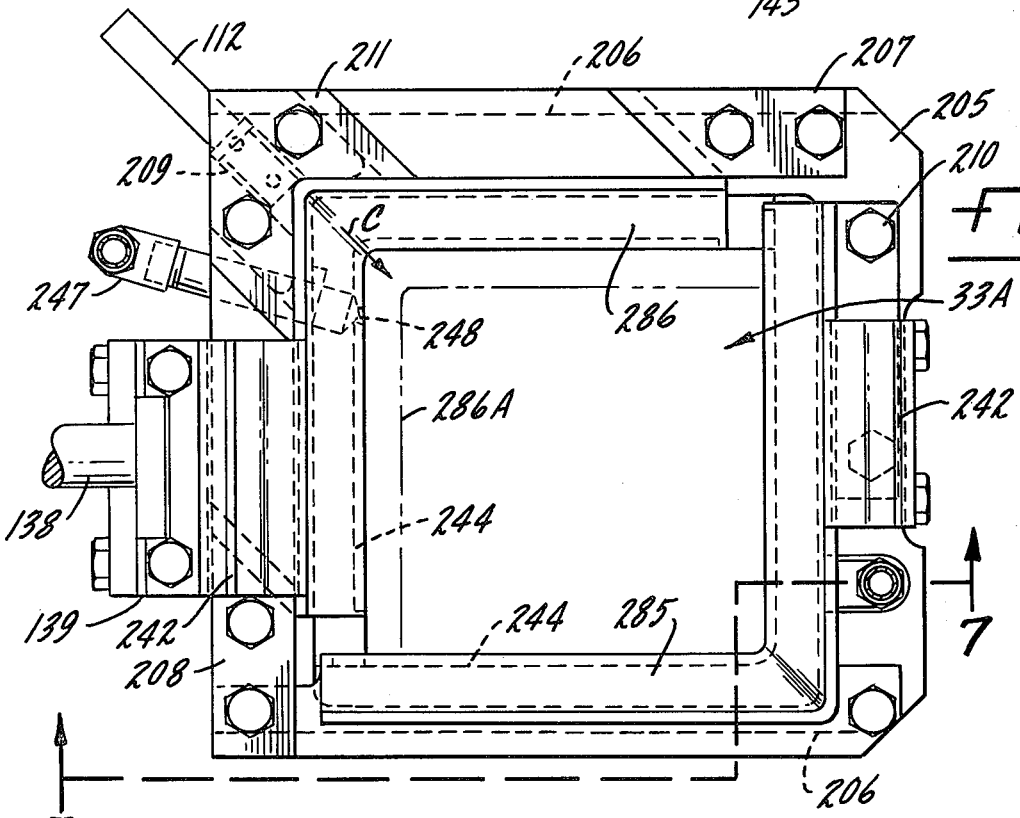
Fig. 6.
Fig. 7.
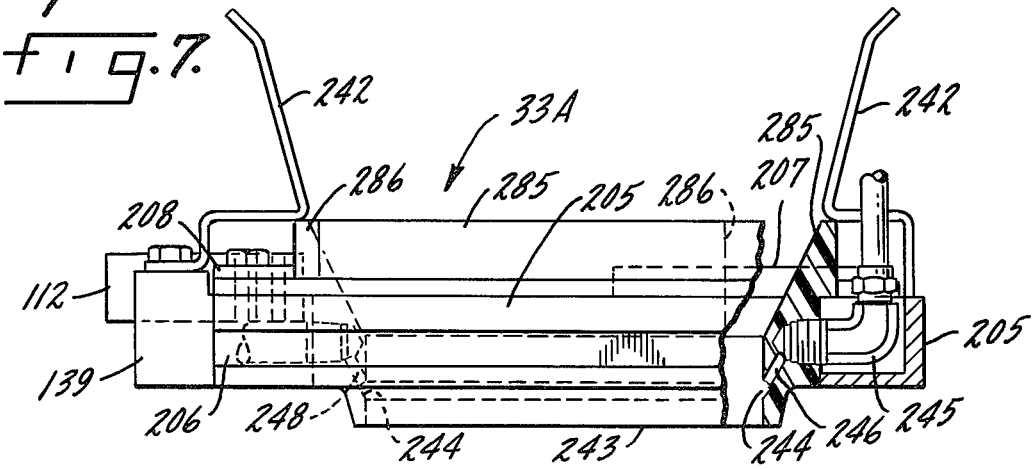

FOOD LOAF SLICING MACHINE

CROSS REFERENCE TO RELATED APPLICATION

The food loaf slicing machine of the present invention preferably incorporates a stacker mechanism of the kind described and claimed in the co-pending application of Glenn A. Sandberg and Scott A. Lindee, Ser. No. 308,252, filed Oct. 5, 1981.

BACKGROUND OF THE INVENTION

Many food loaf products, ranging from bologna and sausage through meat loaf, ham loaf, and other food loaf products, are initially manufactured in long loaves, usually ranging from two to six feet in length. These food loaves are then machine sliced and packaged prior to shipment to retail outlets. A food loaf slicing machine employed in this field should have a high rate of production, preferably in a range of at least two hundred to one thousand slices or more per minute. It is essential that the slices be cleanly and smoothly cut. To avoid undue waste, it is also important to maintain precise and accurate control of the weight of the individual slices as well as the weight of each stack. Continuous operation of the slicing machine is virtually essential, since any interruption required for loading additional loaves or for any other purpose materially reduces the production rate.

In one commercial food loaf slicing machine, each food loaf is fed generally downwardly, by a conveyor mechanism, into a slicing station. As the end of the loaf advances into the slicing station, it is cut off by a rotating orbiting circular knife. The orbiting motion of the knife, which swings the knife into and out of the slicing station, determines the slice rate or production rate of the machine. The rotation of the knife provides a clean slicing action. Machines of this general type, though basically advantageous as compared with other slicing mechanisms, nevertheless present continuing difficult problems.

Different loaf materials may have very different slicing characteristics which require substantially different knife rotation speeds, even though the slicing (orbiting) rate may be the same. Thus, in a slicing machine of the kind that employs a knife having both orbital and rotary motions, with the orbital rate determining the slice rate and the rotational rate determining the cutting rate, a soft material such as bologna or soft sausage may be cut most smoothly and cleanly at a low rotary cutting speed whereas a more dense high muscle content loaf such as a ham loaf may require a much higher rotary speed to achieve comparable results. The optimal cutting rate, relative to the slicing rate, is a matter for empirical determination for virtually any kind of loaf. Consequently, a high production food loaf slicing machine may require a wide range of variation in the ratio of cutting (rotary) speed to slicing (orbital) speed. Although previously known machines have provided for some variation in this regard, the variation has usually been quite limited, particularly because of the common practice of driving the orbital and rotary motions of the knife from a single motor.

To achieve optimally clean, smooth slices, in a high production food loaf slicing machine using an orbiting rotary knife, there should be a working surface, against which the knife works, that matches the contour of the knife edge and its movement through the slicing station.

This is difficult to achieve in the first place and becomes virtually impossible to maintain, when utilizing a preformed metal working surface, due to variations in the knife diameter and knife edge contour that occur when the knife is sharpened.

As manufactured, sausages and other food loaf products are not notable for precise accuracy in their cross-sectional dimensions throughout the lengths of the loaves. Any variation in loaf cross-section produces a corresponding variation in the weight of the individual slices, if the slice thickness is not adjusted to match the cross-sectional changes. A variation of this kind cannot be effectively corrected by the common expedient of weighing each stack of slices as it leaves the slicing machine; it is then too late.

Even though the end of each loaf may be cut off (trimmed) before the loaf is loaded into a high production slicing machine, it is virtually impossible to cut the loaf ends to match precisely with the cutting configuration of the slicer, particularly when using a combination rotary and orbital knife. Thus, when the slicing machine operates continuously, it is a virtual certainty that a limited number of malformed slices will be produced during the transition point from one loaf to another. Usually, this results in a stack of slices that is out of weight tolerance and can be rejected on that basis, but some stacks containing malformed slices may pass through the machine undetected on the basis of weight variations. Furthermore, it is quite difficult to hold the small butt end of a loaf that has been almost completely sliced in accurate alignment in the slicing equipment while that butt portion is being sliced. Of course, the production of substantial numbers of malformed slices leads to material waste that is economically disadvantageous.

In any high production meat loaf slicing machine, the weight of the individual slices and the weight of each stack of slices is critically dependent upon the rate at which the food loaf is fed into the slicing station. The minimum weight for each stack presents an absolute requirement in order to avoid violations of packaging laws. Consequently, it is customary to adjust the slicing machine to assure the production of stacks that always exceed the minimum weight that will be marked on the completed packages. The built-in system waste from this source can be an appreciable adverse factor in the economics of a packaging operation. The smaller the increments for control of the rate at which the loaf is fed into the slicing station, the greater the potential for economical operation.

SUMMARY OF THE INVENTION

It is a principal object of the present invention, therefore, to provide a new and improved high volume food loaf slicing machine, utilizing an orbiting rotary knife, in which the food loaf is fed to the slicing station at a precisely controlled feed rate, variable in extremely small increments, producing cleanly cut uniform weight slices from a wide variety of loaf materials, and capable of accommodating appreciable variations in cross-sectional area of the loaf.

A particular object of the invention is to provide a new and improved high volume food loaf slicing machine of the kind in which a food loaf is continuously fed into a slicing station to be sliced by an orbiting rotating knife, in which the rotational speed of the knife can be continuously adjusted over a broad speed range independently of the orbiting rate for the knife.

Another object of the invention is to provide a highly accurate contour for the stationary working surface opposed to an orbiting rotating knife, in a high volume food loaf slicing machine, a contour, that accurately matches the shape of the knife edge and the path of movement of the knife edge through the slicing station. A feature of the invention pertaining to this object is the provision of a molded resin collar in the slicing station, affording the requisite working surface opposed to the knife, that can be cut to the desired configuration by the knife itself, so that wear and sharpening of the knife do not result in a mismatch between the knife and its opposed working surface.

Another object of the invention is to provide means for detecting variations in the cross-sectional area of a food loaf, as it enters the slicing station of a high volume slicing machine, to permit adjustment of the rate at which the food loaf is fed into the slicing station and thereby maintain uniformity in slice weight despite appreciable changes in food loaf cross-sectional area.

Another object of the invention is to provide a means for detecting and monitoring the location of a loaf-to-loaf transition, in the loaf feed apparatus of a high volume food loaf slicing machine, to enable automatic rejection of the slices formed during the loaf transition.

Another object is to provide a new and improved collar for use in the slicing station of a continuous high volume food loaf slicer that affords improved control of the end portion of a loaf so that the number of clean slices of uniform weight is maximized.

Accordingly, in one aspect the invention relates to an improved high volume food loaf slicing machine of the kind comprising a loaf support, supporting a food loaf for movement along a downwardly inclined path, loaf feed conveyor means, positioned at the lower end of the food loaf path, for continously advancing a food loaf along that path and into a slicing station; and a rotary knife, supported for orbital movement into and out of the slicing station in a direction transverse to the food loaf path, for cyclically cutting individual slices from the loaf as the loaf enters the slicing station. The improvement comprises variable speed main drive motor means, knife orbit drive connection means, connecting the main drive motor means to the knife to drive the knife through its orbital movement at a slicing rate determined by the speed of the main drive motor means, conveyor drive connection means, connecting the main drive motor means to the loaf feed conveyor means to drive the conveyor means at a loaf feed rate determined in part by the speed of the main drive motor means, and variable speed knife rotation motor means, connected to the knife to drive the knife through its rotary motion at a cutting rate determined by the speed of the knife rotation motor means and independent of the speed of the main drive motor means. A collar encompasses the loaf at the entrance to the slicing station, the collar being of transverse split construction, including first and second collar members, one collar member being movable toward and away from the other in a direction transverse to the food loaf path; collar closure means, connected to the one collar member, biases the movable collar member toward the other collar member to maintain both collar members in predetermined limited pressure engagement with the lowermost end of the feed loaf but permitting continuous movement of the loaf through the collar. A loaf size sensor is connected to the one collar member, for sensing movements of the one collar member indicative of variations in cross-sectional area of the loaf; control means, connected to the loaf size sensor, actuates the conveyor drive connection means to vary the loaf feed conveyor speed to compensate for changes in loaf cross-sectional area.

In another aspect, the invention relates to an improved high volume food loaf slicing machine of the kind comprising a loaf support, supporting a food loaf for movement along a downwardly inclined path, loaf feed conveyor means, positioned at the lower end of the food loaf path, for continuously advancing a food loaf along that path and into a slicing station, a rotary knife, supported for orbital movement into and out of the slicing station in a direction transverse to the food loaf path, for cyclically cutting individual slices from the loaf as the loaf enters the slicing station, variable speed knife orbit drive means for driving the knife through its orbital movement at a predetermined slicing rate, variable speed conveyor drive means for driving the conveyor means at a predetermined loaf feed rate, and variable speed knife rotation drive means for driving the knife through its rotary motion at a predetermined cutting rate. The improvement comprises a collar encompassing the loaf at the entrance to the slicing station, the collar being of transverse split construction, including first and second collar members, one collar member being movable toward and away from the other in a direction transverse to the food loaf path, collar closure means, connected to the one collar member, for biasing the movable collar member toward the other collar member to maintain both collar members in predetermined limited pressure engagement with the lowermost end of the feed loaf but permitting continuous movement of the loaf through the collar, a loaf size sensor, connected to the one collar member, for sensing movements of the one collar member indicative of variations in cross-sectional area of the loaf, and control means, connected to the loaf size sensor, for actuating the conveyor drive connection means to vary the loaf feed conveyor speed to compensate for changes in loaf cross-sectional area.

BRIEF DESCRIPTION OF THE DRAWINGS

FIG. 5 is a detail view taken approximately as indicated by line 5—5 in FIG. 4;

FIG. 6 is a detail view corresponding to a portion of FIG. 4 but illustrating a modification of the slicing station collar to accommodate a different loaf configuration;

FIG. 7 is a detail view, partly in cross section, taken approximately along line 7—7 in FIG. 6;

DESCRIPTION OF THE PREFERRED EMBODIMENTS

Figure 1:
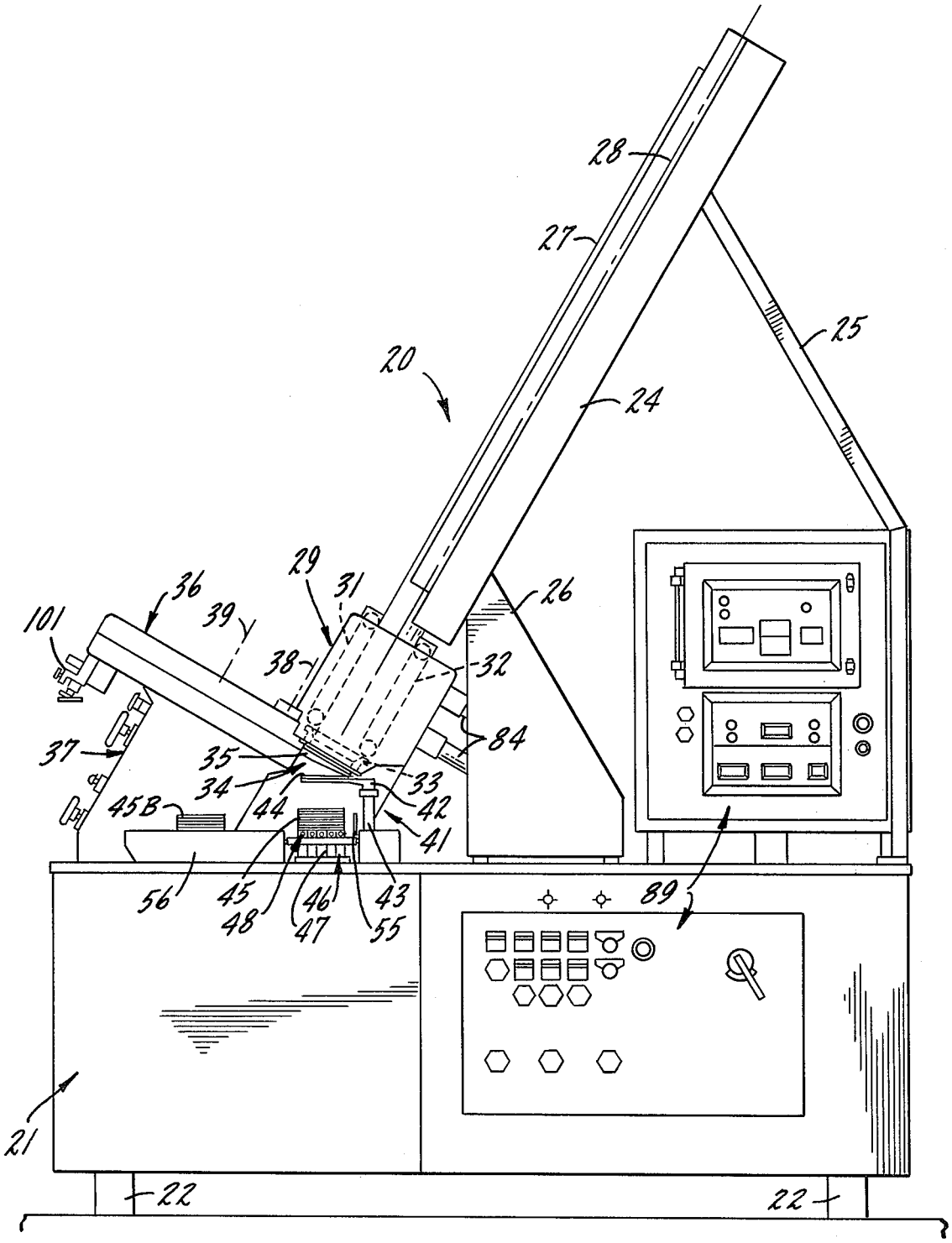
FIG. 1 is a side elevation view of a high volume food loaf slicing machine constructed in accordance with a preferred embodiment of the present invention.

FIG. 1 illustrates a high volume food loaf slicing machine 20 constructed in accordance with a preferred embodiment of the present invention. Slicing machine 20 comprises a base 21 mounted on legs 22. Base 21 is enclosed and affords a housing for penumatic, hydraulic, and electrical apparatus for operating the machine Slicing machine 20 comprises a food loaf support 24 mounted on base 21 by suitable means such as the frame members 25 and 26. Loaf support 24, supports a food loaf 27 for movement along a downwardly inclined path generally indicated by line 28. The lower end of loaf 27 is engaged by two belt conveyors 31 and 32 incorporated in a loaf feed mechanism 29. The lower end of the food loaf path 28 terminates at a collar 33 which defines the entrance to a slicing station 34.

A disc-shaped rotary knife 35 is incorporated in slicing machine 20 in a knife head 36 mounted on a drive assembly 37 in turn mounted on the top of machine base 21. Knife 35 is of slightly concave configuration, with the concavity facing upwardly. Knife 35 is driven to perform two movements; the knife rotates about a first axis 38 and also orbits about a second axis 39. The orbital motion about axis 39 moves knife 35 cyclically into and out of slicing station 34. The cyclical rate of orbital motion of knife 35 is the slicing rate of machine 20. In FIG. 1, knife 35 is shown at the completion of a slicing operation and is beginning to move out of the slicing station.

A food loaf slice stacker 41 is incorporated in slicing machine 20 immediately below slicing station 34. Stacker 41 comprises two pair of stacker grids 42 mounted on vertically movable rotatable support shafts 43; grids 42 are better shown in FIG. 2. Stacker grids 42 catch each food loaf slice 44 as cut in slicing station 34, FIG. 1, accumulating a stack 45 containing a predetermined number of slices and depositing that stack on a weight scale 46 positioned immediately below the stacker. The only portion of scale 46 shown in the drawings comprises the upwardly extending vanes 47 on which each stack 45 is deposited for weighing. The operating mechanisms for scale 46 and stacker 41 are incorporated in base 21 of slicing machine 20; these operating mechanisms are not illustrated in the drawings because they form no part of the present invention. A preferred basic construction for stacker 41 and scale 46 is described and claimed in the aforementioned copending application of Glenn A. Sandberg and Scott A. Lindee, Ser. No. 308,252, filed Oct. 5, 1981.

Figure 2:
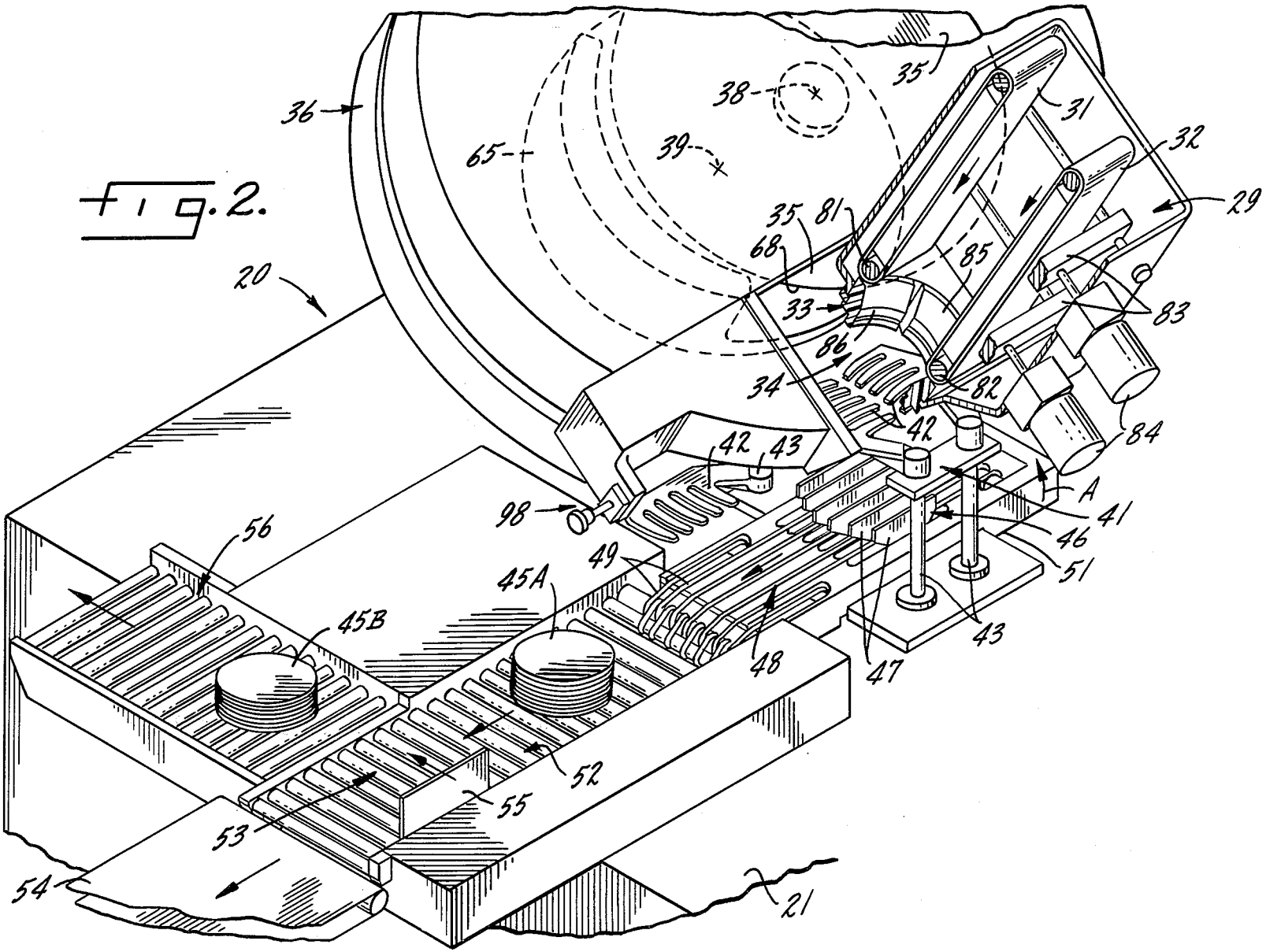
FIG. 2 is a perspective view of major components of the slicing machine of FIG. 1, with some parts cut away to reveal others.

A scale conveyor 48 is incorporated in slicing machine 20. As best shown in FIG. 2, conveyor 48 comprises a plurality of flexible bands or O-rings 49 that extend between vanes 47 of scale 46. Conveyor 48 includes a frame 51 that can be tilted upwardly as indicated by arrow A so that the conveyor bands 49 lift a stack of meat slices from vanes 47 and discharge the stack onto a powered roller conveyor 52 as indicated by stack 45A in FIG. 2. Conveyor 52 moves each stack to a classification station 53. Stacks that are within acceptable weight limits are discharged onto an "on weight stack" conveyor 54. For stacks outside of the weight limits a diversion mechanism comprising a pusher plate 55 diverts the stack to an "off weight" stack conveyor 56 as indicated by stack 45B in FIG. 2.

As thus far described, apart from the stacker and scale mechanism, slicing machine 20 is generally conventional in construction. A large bologna, sausage, meat loaf, ham loaf, or other food loaf 27 is placed in support 24. Usually, the ends of loaf 27 are trimmed before the loaf is loaded into machine 20. The lower end of loaf 27 is engaged by the two loaf conveyors 31 and 32 of loaf feed mechanism 29 and is moved downwardly by those conveyors until the lower end of the loaf, moving along path 28, enters collar 33. As the end of the loaf emerges from collar 33 into slicing station 34, knife 35 slices individual slices 44 of predetermined thickness from the end of the loaf. Loaf movement is continuous. The thickness of each slice is determined by the feed rate at which loaf 27 is advanced into slicing station 34. As previously noted, the slicing rate is the orbiting rate of knife 35.

When slicing machine 20 is first placed in operation, one pair of stacker grids 42 is positioned in the raised closed position shown in FIG. 1. After a preselected number of slices 44 are accumulated on this pair of stacker grids, the grids are lowered by shafts 43 to deposit the stack 45 on vanes 47 of scale 46. The tines of the grids fit between the vanes. During this operation, a second pair of stacker grids 42 is moved into position immediately below slicing station 34 to receive succeeding slices cut from loaf 27 and form a new stack.

As each stack of slices 45 is deposited on scale 46, it is weighed. The scale provides an output signal indicative of whether the stack is within preselected weight limits or outside of those limits. The on weight stacks are discharged by scale conveyor 48 onto conveyor 52 and continue their movement directly outwardly of the machine along take-away conveyor 54 (FIG. 2). The off weight stacks are diverted, by diverter 55, onto the off weight stack conveyor 56.

Figure 3:
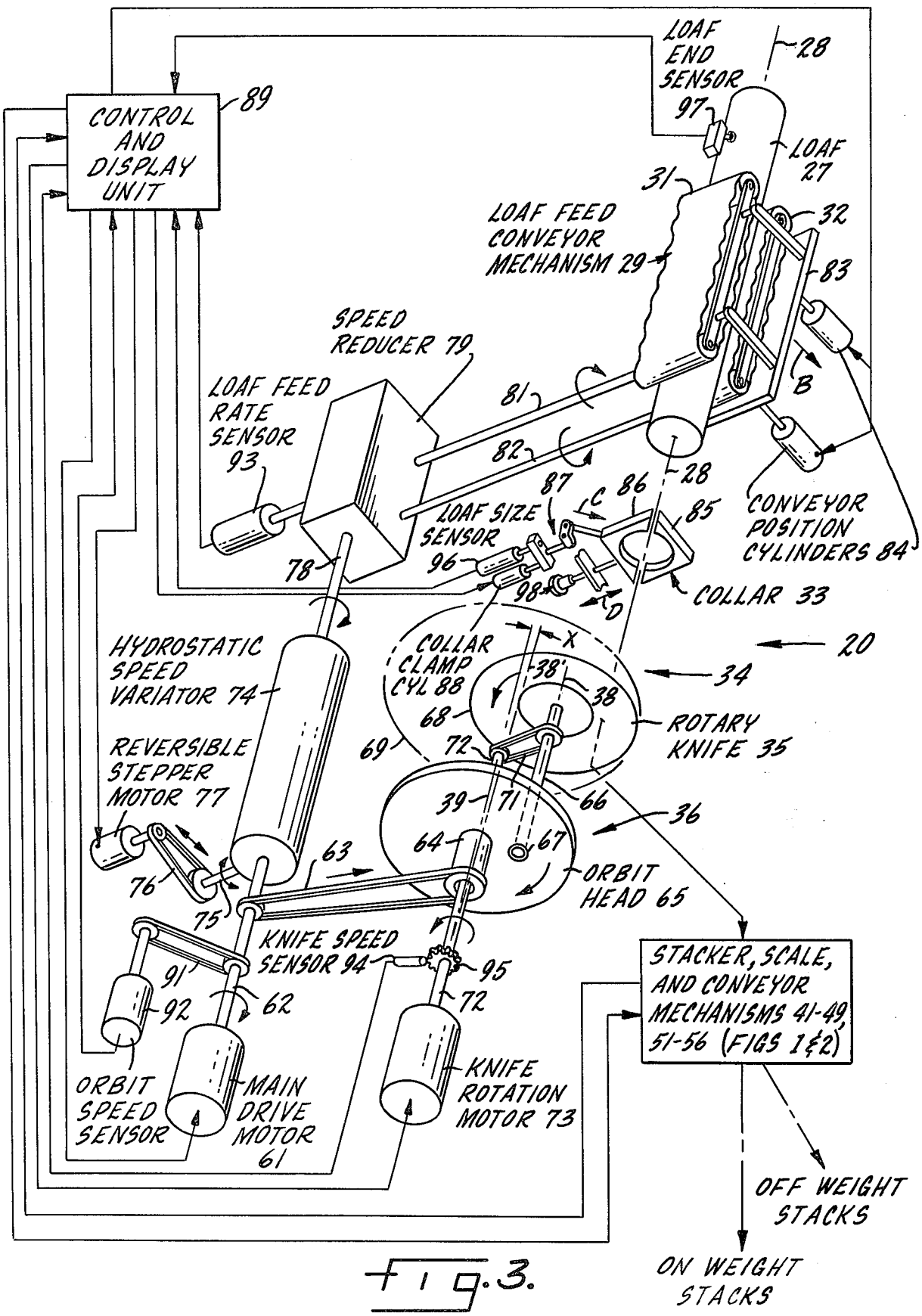
FIG. 3 is a schematic exploded view of the slicing mechanism for the high volume food loaf slicing machine of FIGS. 1 and 2.

FIG. 3, taken in conjunction with FIG. 2, illustrates many of the principal features of the present invention as incorporated in slicing machine 20. As shown in FIG. 3, slicing machine 20 comprises a main drive motor 61 having an output shaft 62. Preferably, motor 61 is a hydraulic motor provided with control means for adjusting the motor speed over a broad, continuous speed range. Shaft 62 is connected, by an appropriate drive connection 63, to a hollow shaft 64 on which an orbit head 65 is mounted. The centerline of shaft 64 is the orbital axis 39. Although the drive connection means 63 is shown, for purposes of convenience, as a belt and pulley drive, it should be understood that a suitable gear train or other drive connection can be utilized as desired.

In the construction illustrated in FIG. 3, the rotary knife 35 is mounted on a rotational drive shaft 66. The centerline of shaft 66 is the rotational axis 38. The end of shaft 66 opposite knife 35 is journalled in a bearing 67 mounted in orbit head 65, so that the cutting edge 68 of knife 35 describes the orbital path 69. Shaft 66 is connected by an appropriate drive connection 71 to the output shaft 72 of a knife rotation motor 73, shaft 72 extending through the hollow orbiter shaft 64. As in the case of drive connection 63, drive connection 71 is shown as a belt and pulley drive, but a gear train or other drive connection can be used as desired. Knife rotation motor 73, like main drive motor 61, is preferably a hydraulic motor equipped with control means for adjusting the motor speed over a broad, continuous speed range (see FIG. 8).

The main drive shaft 62 from motor 61 also constitutes the input shaft of a hydrostatic speed variator device 74. Device 74 has a speed adjustment shaft connected by suitable drive connection means 76, again conveniently shown as a belt and pulley drive connection, to the output shaft of a small electrical stepper motor 77. The speed variation device 74 has an output shaft 78 that constitutes the input shaft of a speed reducer 79. There are two output shafts 81 and 82 from speed reducer 79. Shaft 81 is the drive shaft for loaf feed conveyor belt 31 and shaft 82 is the drive shaft for loaf feed belt conveyor 32. Of course, it will be understood that the speed reducer 79 may have a single output shaft connecte to the two loaf feed conveyor belts by suitable gearing or other drive connection means.

To accommodate loaves 27 of varying cross sectional dimensions, it is necessary to provide for adjustment of the two loaf feed belt conveyors 31 and 32 toward and away from each other. In the arrangement schematically illustrated in FIG. 3, this is accomplished by mounting belt conveyor 31 on a movable frame 83. Two conveyor position cylinders 84 are connected to frame 83 and are utilized to bias belt conveyor 31 toward conveyor 32 in the direction of the arrow B.

Collar 33, as shown in FIG. 3 and in FIG. 2, is of split construction, comprising two collar members 85 and 86. Collar member 86 is connected to a position adjustment linkage 87, described in detail in connection with FIG. 4. Linkage 87 is connected to a collar clamp cylinder 88. Cylinder 88, acting through linkage 87, is employed to adjust the position of collar member 86 in relation to collar member 85 to conform to the cross-sectional configuration of food loaf 27. The central aperture of collar 33, as shown in FIGS. 2 and 3, is of circular configuration, conforming to the cross sectional configuration of loaf 27 as illustrated. However, collars of different shapes can be used to accomodate loaves having different shapes; a collar appropriate for a loaf of square cross section is described in connection with FIGS. 6 and 7.

Food loaf slicing machine 20, as shown in FIG. 3 includes controls for the various operating units of the machine, shown generally as a control and display unit 89. To afford adequate information for effective control of the slicing machine, a number of parameters are continuously monitored. One basic parameter for slicing machine 20 is the operating speed of main drive motor 61, which controls the orbiting speed of knife 35 and which is also one determining factor for the loaf feed rate established by the operating speeds of loaf feed conveyors 31 and 32. Shaft 62 of motor 61 is connected by a suitable drive connection 91 to an orbit speed sensor 92 that provides one electrical input connection to control unit 89. Due to the speed variation afforded by device 74, the speed of drive motor 61 is not precisely representative of the loaf feed rate, though it is a determining factor in establishing that rate. To monitor the loaf feed rate, a sensor 93 is connected to speed reducer 79 and affords a second input to control unit 89.

In slicing machine 20, the rotational speed of knife 35 is independent of the orbital speed of the knife. For effective control, control unit 89 is provided with information as to the actual rotational speed of rotary knife 35. This information is derived from a knife speed sensor 94, comprising a proximity switch aligned with a multiple-tooth wheel 95 affixed to shaft 72 of knife rotation motor 73.

The position of movable collar member 86 relative to fixed collar member 85, in collar 33, is indicative of the cross sectional area of that portion of food loaf 27 extending into collar 33, and about to enter slicing station 34, at any given time. Because any change in cross sectional area of the food loaf produces a change in weight of a slice of given thickness cut from the loaf, it is highly desirable to provide control unit 89 with instantaneous information regarding any changes in the position of collar member 86. This is accomplished by a loaf size sensor 96 that is mechanically connected to the same linkage 87 that adjusts the position of collar member 86. Sensor 96 is preferably a linear voltage differential transformer (LVDT) and is electrically connected to control unit 89.

With substantial changes in loaf cutting characteristics, from one type of loaf to another, the location of the collar 33 may need to be changed to maintain stacking centered on the stacking grids 42. To maintain collar 33 in position to deposit slices in centered relation on the stacking grids, a manual position adjustment device 98 for collar 33 is provided in machine 20 (FIG. 3).

In the operation of slicing machine 20, it is desirable to know when a new food loaf 27 should be loaded into the machine. Furthermore, it is desirable to monitor movement of the transition between two loaves into collar 33 at the entrance of slicing station 34 so that at least a few slices from the trailing end of the loaf being exhausted and a few slices from the lead end of the next loaf can be diverted, inasmuch as these transition slices will not constitute a uniform stack matching the good stacks formed by machine 20. Moreover, if collar 33 includes a vacuum assist for holding the butt end of a loaf in the collar after it has cleared conveyor mechanism 29, control unit 89 requires information from which that vacuum assist can be controlled. Accordingly, at least one loaf end sensor 97 is incorporated in machine 20 immediately above loaf feed conveyors 31 and 32 and is electrically connected to the control and display unit 89.

The operator of slicing machine 20 should be provided with information regarding machine operation, including stack weight, slicing speed, and cumulative production data. To this end, appropriate displays are incorporated in the slicing machine, as shown in FIG. 1. The display information is derived from the information supplied to control unit 89 by the various sensors shown in FIG. 3 and by the weight scale of the machine.

In slicing of a given type of food load 27 in slicing machine 20, it is necessary that both of the loaf feed conveyors 31 and 32 firmly engage the food loaf to assure controlled movement along path 28. This is effected by operation of the two conveyor position cylinders 84, which are actuated to urge conveyor 31 toward conveyor 32 as indicated by the dual arrow B. There is no set-up adjustment required; cylinders 84 are actuated with limited pneumatic pressure continuously during operation of machine 20. They afford sufficient "give" so that the conveyor mechanism 29 can accommodate minor changes in cross sectional area of the individual food loaves.

As a part of machine set-up, a suitable collar 33, adapted to accommodate the particular loaves 27 being sliced, is installed in machine 20. One specific collar 33 having a circular central aperture between collar members 85 and 86 can accommodate a moderate range of different loaf sizes. However, it may be necessary to have two or more collars for a substantial range of loaf sizes, even if all of the loaves are of circular cross sectional configuration.

As previously noted, the bottom surfaces of the collar members 85 and 86 of collar 33 afford a working surface cooperating with the cutting edge 68 of rotary knife 35. The contour of that working surface should be closely matched to the contour of knife edge 68 and its path of rotary orbital movement through slicing station 34. To obtain a matching contour for collar 33, collar members 85 and 86 are preferably formed of a molded machinable resin, such as Delrin nylon resin. Before machine 20 is placed in operation with a given pair of collar members 85 and 86, knife 35 is moved a short distance upwardly along its axis 38 and is employed to cut the lower surfaces of the two collar members to the precise desired contour.

Like any other cutting knife, rotary knife 35 is subject to wear. Consequently, slicing machine 20 may be provided with a honing device 101 to sharpen knife 35 in place. After excessive wear or because of some physical damage it will be necessary to remove the knife and have it reground. There will then be a sufficient change in contour of its cutting edge so that the contour of the cooperating surface on collar 33 no longer provides an adequate match. In these circumstances, knife 35 may again be used to shape the bottom surface of the collar members to afford a close match with the knife. In this manner, a precision match between the cutting edge of knife 35 and the cooperating lower surface of collar 33 is maintained, in machine 20, to assure clean, smooth slices.

Relatively soft food loaves 27 are cut most smoothly and cleanly at relatively low rotary cutting speeds, whereas dense loaves of high muscle content require higher rotary knife speeds, as noted above. On the other hand, it may be desirable to operate machine 20 at the same slicing rate (orbiting rate) for a "soft" food loaf such as bologna as for a relatively "hard" food loaf such as a ham loaf. Slicing machine 20 readily accommodates these requirements through the provision of knife rotation drive means, comprising motor 73, that is adjustable in speed entirely independently of the main drive motor 61 that drives both the orbit head 65 and the loaf feed conveyors 31 and 32. In a typical embodiment of slicing machine 20, the slicing rate determined by main drive motor 61 may be adjustable continuously over a range from a minimum of two hundred slices per minut up to a maximum of one thousand slices per minute. The same machine may provide a range of knife rotation speeds from two hundred to thirty-six hundred rpm by adjustment of the operating speed for knife rotation motor 73. The optimal cutting rate for any particular type of food loaf is determined empirically. The independent adjustment of the ratio of cutting rate to slicing rate afforded by slicing machine 20 makes it possible to obtain optimum slicing for food loaves having very different slicing characteristics.

When slicing machine 20 is first placed in operation, while motors 61 and 73 are coming up to speed, power clamp cylinder 88 (FIG. 3), operating through linkage 87, drives collar member 86 toward collar member 85 with sufficient force to clamp the collar against the end of loaf 27 and prevent the loaf from moving along path 28 into slicing station 34. When the drives for the slicing machine are up to an operating speed range, the clamping pressure at collar 33 is released. However, throughout continuing operation of machine 20, a limited pressure is applied to collar member 86 by cylinder 88 to afford firm engagement of the collar with loaf 27. In consequence, during slicing operations any movement of collar member 86 toward and away from its mating collar member 85, along the path indicated by the arrow C, affords a direct indication of variations in the cross sectional area of food loaf 27.

Food loaf products may exhibit appreciable variations in their cross sectional areas, from loaf to loaf and within a given loaf. These variations are detected by loaf size sensor 96 through its connection to linkage 87 and collar member 86. This information, supplied to control unit 89, makes it possible to adjust the hydrostatic speed variator 74 to accommodate even relatively small changes in cross sectional configuration of loaf 27 as it approaches slicing station 34.

The thickness of the slices cut from loaf 27 in slicing machine 20 is determined in part by the operating speed of main drive motor 61, since the loaf feed conveyors 31 and 32 are driven from this motor. However, slice thickness is also determined by the setting of the hydrostatic speed variator 74, which is effective to adjust the speed of its output shaft 78 over a broad range relative to the speed of its input shaft, which is the output shaft 62 of motor 61. This adjustment is effected by rotation of the control shaft 75 of device 74, in turn determined by the electrical stepper motor 77. The use of stepper motor 77 makes it possible to adjust the angular orientation of shaft 75 by very small increments. Consequently, it can be seen that the drive for loaf feed conveyors 31 and 32 affords precise control of thickness, and hence weight, for each individual slice cut by machine 20. While machine 20 is in operation, the position of shaft 75, controlled by stepper motor 77, can be modified in accordance with stack weight information derived from the scale 46 (FIGS. 1 and 2) of the slicing machine, as well as loaf cross sectional variations determined by loaf size sensor 96 (FIG. 3).

The output signal from loaf end sensor 97 (FIG. 3) signals control and display unit 89 when the end of loaf 27 reaches that sensor. Control unit and display 89 can then provide an appropriate warning to the operator to load a new loaf into the machine, or can actuate a loaf loader to place a new loaf in support 24. Furthermore, since control unit 89 receives information regarding the rate at which the loaf is being advanced into slicing station 34 from loaf feed rate sensor 93, the control unit can readily determine when the loaf transition reaches collar 33. Thus, control unit 89 is able to actuate a vacuum assist in collar 33, as described below, and can also actuate the output conveyor mechanisms of slicing machine 20 (FIG. 2) to divert any stack formed by slicing a loaf transition to the off weight stack conveyor Because conveyor mechanism 29 operates continuously, even with an upwardly concave knife 35 there can be a substantial problem of the trailing edge of the knife "scrubbing" across the face of loaf 27 in the latter part of a cutting cycle. This scrubbing action roughens the loaf face (a surface of the next slice), causes fat separation, and has other undesirable surface effects.

To eliminate such scrubbing, the cutting axis 38 of knife 35 is inclined at a very small angle relative to the orbital axis 39, as indicated (in exaggerated manner) by the tiny angle X between axis 39 and line 38', parallel to axis 38, in FIG. 3. The inclination is such that the leading edge of knife 35 entering slicing station 34 is higher than the trailing edge. In a slicing machine using a knife 35 of about eighteen inches diameter, angle X may be as small as 0.5°. Nevertheless, even this small inclination of the cutting axis provides a material improvement in providing clean, smooth slices as the output of machine 20.

Figure 4:
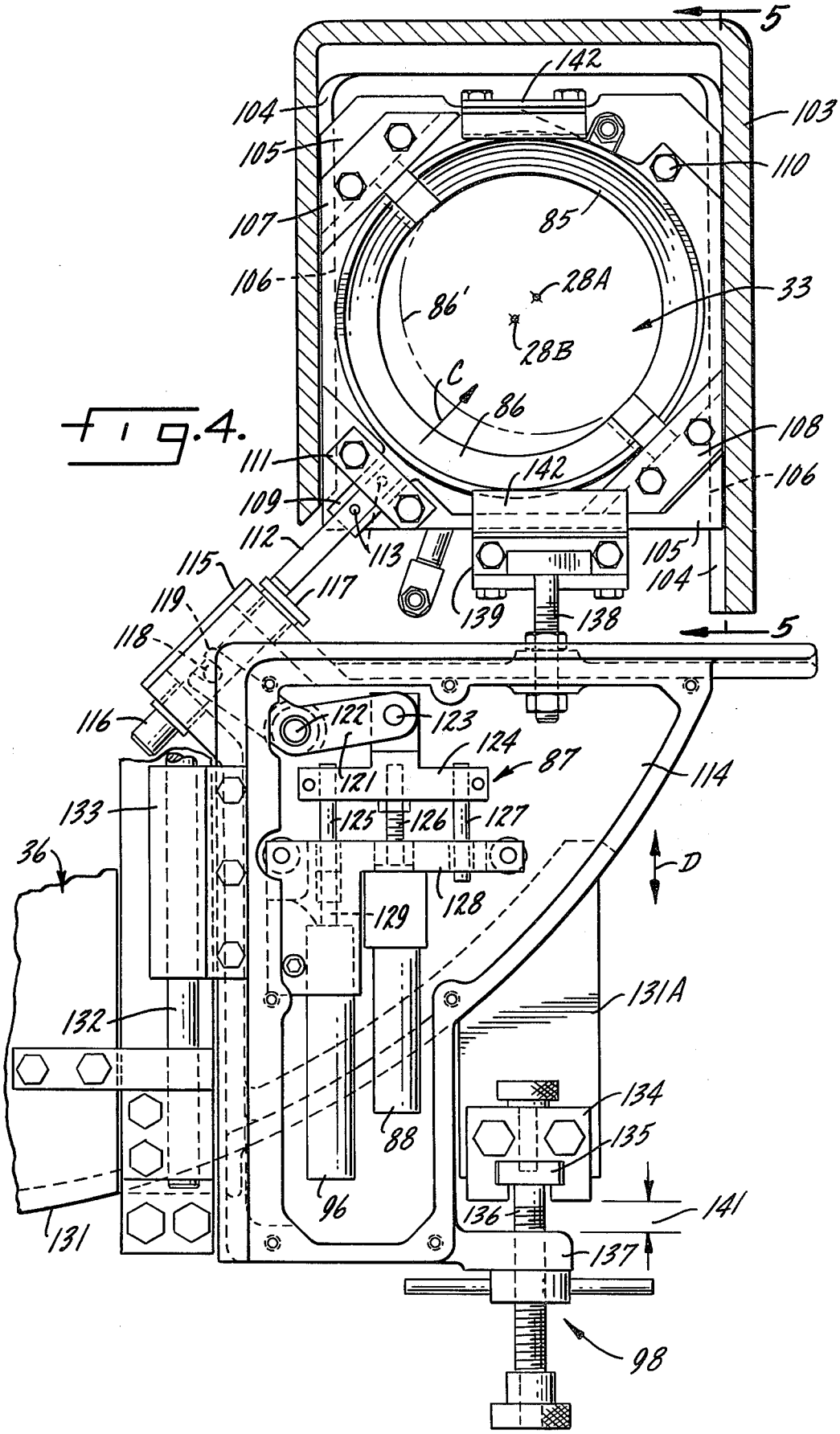
FIG. 4 is a detail view of the slicing station collar mechanism for the slicing machine of FIGS. 1–3, looking downwardly along the path of loaf movement.

FIGS. 4 and 5 illustrate a preferred construction for collar 33 and linkage 87, together with the manual positioning adjustment device 98 for the loaf collar. As shown in FIG. 4, collar 33 may be supported in a generally C-shaped housing or frame 103 having two collar support slides 104 extending along opposed sides of the frame. The specific construction for collar 33 shown in FIGS. 4 and 5 comprises a rectangular base 105 having elongated grooves 106 along opposed sides that fit onto the slides 104.

The two collar members 85 and 86 of collar 33 are mounted in the collar base 105, being held in place by two clamp members 107 and 108 at opposite corners of the base. A bolt 110 secures collar segment 85 in fixed position on base 105. Collar member 86, on the other hand, has limited movement in the direction indicated by the arrow C. Collar member 86 is shown at its furthest displacement from collar member 85. If closed upon collar member 85 as completely as possible, the inner surfaces of the two collars would be as indicated by phantom line 86'.

Collar member 86 includes an integral shaft connection element 109 covered by a shaft guide 111 secured to collar base 105. A longitudinally movable shaft 112 is mounted in the shaft connection element 109 by suitable means such as the dowel pins 113.

The collar adjustment linkage 87, in the construction shown in FIG. 4, is mounted upon a slidably movable base 114. At the upper left-hand corner of base 114, as seen in FIG. 4, a guide 115 projects outwardly of the base; a longitudinally movable shaft 116 is mounted in guide 115. The end 117 of shaft 116 engages the outer end of shaft 112. A pin 118 mounted on shaft 116 is engaged by a fork 119 comprising one end of a crank 121. Crank 121 is pivotally mounted on a pin 122 secured to slide base 114. The other arm of the crank is pivotally connected, by a pin 123 to a yoke 124. Three small guide shafts 125, 126 and 127, affixed to yoke 124 extend from the yoke into suitable guide bearings in a stationary guide member 128 mounted on base 114.

The collar clamp cylinder 88 is mounted on guide member 128 on slide base 114. The piston rod of cylinder 88 comprises shaft 126. The loaf size sensor 96, on the other hand, has an operating rod 129 connected to guide shaft 125, this sensor also being mounted on guide member 128.

Base 114 is slidably mounted upon the frame 131 of knife head 36 for limited sliding movement as indicated by the arrow D. A guide shaft 132 mounted on frame 131 is engaged by an elongated guide member 133 affixed to the sliding base 114.

A portion 131A of frame 131 extends under base 114. A guide block 134 is mounted on frame member 131A and a member 135 is mounted in a slot in the guide block. Member 135 is affixed to the end of a shaft 136 that is threaded into an arm 137 formed integrally with and projecting outwardly of the slide base 114. Elements 134–137 are all a part of the manual adjustment device 98 for collar 33.

When slicing machine 20 is in operation, slicing a food loaf that extends into the central aperture in collar 33, the collar is urged into contact with the food loaf by applying pressure to collar member 86 in the direction of arrow C. This limited pressure contact is maintained by means of cylinder 88, acting through the linkage comprising shaft 126, yoke 124, crank 121 and shafts 116 and 112. Thus, cylinder 88, by pulling outwardly on its piston rod, shaft 126, urges crank 121 toward movement in a clockwise direction, applying force to shafts 116 and 112 in the direction of arrow C and biasing collar member 86 into engagement with the food loaf. This action maintains collar 33 in predetermined limited pressure engagement with the food loaf throughout the slicing operation. Any variations in food loaf cross sectional area are reflected in limited movements of linkage 87 culminating in limited shifting of yoke 124. Thus, the LVDT sensor 96 is able to detect small changes in loaf area as the loaf moves into collar 33, making it possible to correct the food loaf feed rate and maintain slices of essentially uniform weight.

Different food loaf products, as cut off by knife 35, have different "throw" properties, tending to displace the slices relative to the stacker grids 42 (FIG. 2). Collar 33 is movable to maintain the stack position on the center of the stacking grids, thus centering the stacks on the weight scale.

"Throw" variations are accommodated by means of the adjustment device 98. In FIG. 4, device 98 is shown at one extreme end of its range of movement, with collar 33 in position to accommodate a food loaf centered approximately on path 28B. To reach the other extreme 28A of food loaf path variations, the threaded shaft 136 is retracted toward arm 137, shortening the portion of the shaft between members 134 and 137 and effectively advancing slide base 114 upwardly as seen in FIG. 4. Slide base 114 is connected to base 105 of collar 33 by a shaft 138, connected to a block 139 on base 105. Consequently, the range of manual adjustment for collar 33 is as indicated by reference numeral 141.

To aid in starting a new loaf into the collar, it may be desirable to provide entrance guides on collar 33 to direct the food loaf into the collar. In the construction illustrated in FIGS. 4 and 5, this function is provided by two spring guides 142 mounted on opposite sides of collar base 105.

FIGS. 6 and 7 show an alternate collar assembly 33A adapted for use with a food loaf of rectangular cross sectional configuration. As before, collar 33A is of split construction, including two collar members 285 and 286. The collar members are clamped to a base 205 by a series of clamps 207,208 and 211. Collar member 285 is held in fixed position on base 205 as by a bolt 210. Base 205 has grooves 206 along two side edges to fit in sliding relation on the ways 104 of frame 103 (FIG. 4).

In collar 33A, FIGS. 6 and 7, the two collar members 285 and 286 are each of right angle configuration. The corner of the movable collar member 286 includes a shaft connection element 209 pinned to the shaft 112 to provide for movement of this collar member in the direction of arrow C. The manual adjustment connection is the same as in the previously described construction, including block 139 and its connection to shaft 138. As before, collar 33A may be provided with two spring guides 242, mounted on base 205, to guide a loaf into the central aperture of the collar. Operation of collar 33A is the same as described above for collar 33, so that the operational description need not be repeated. Full closed condition is shown by line 286A.

Figure 9:
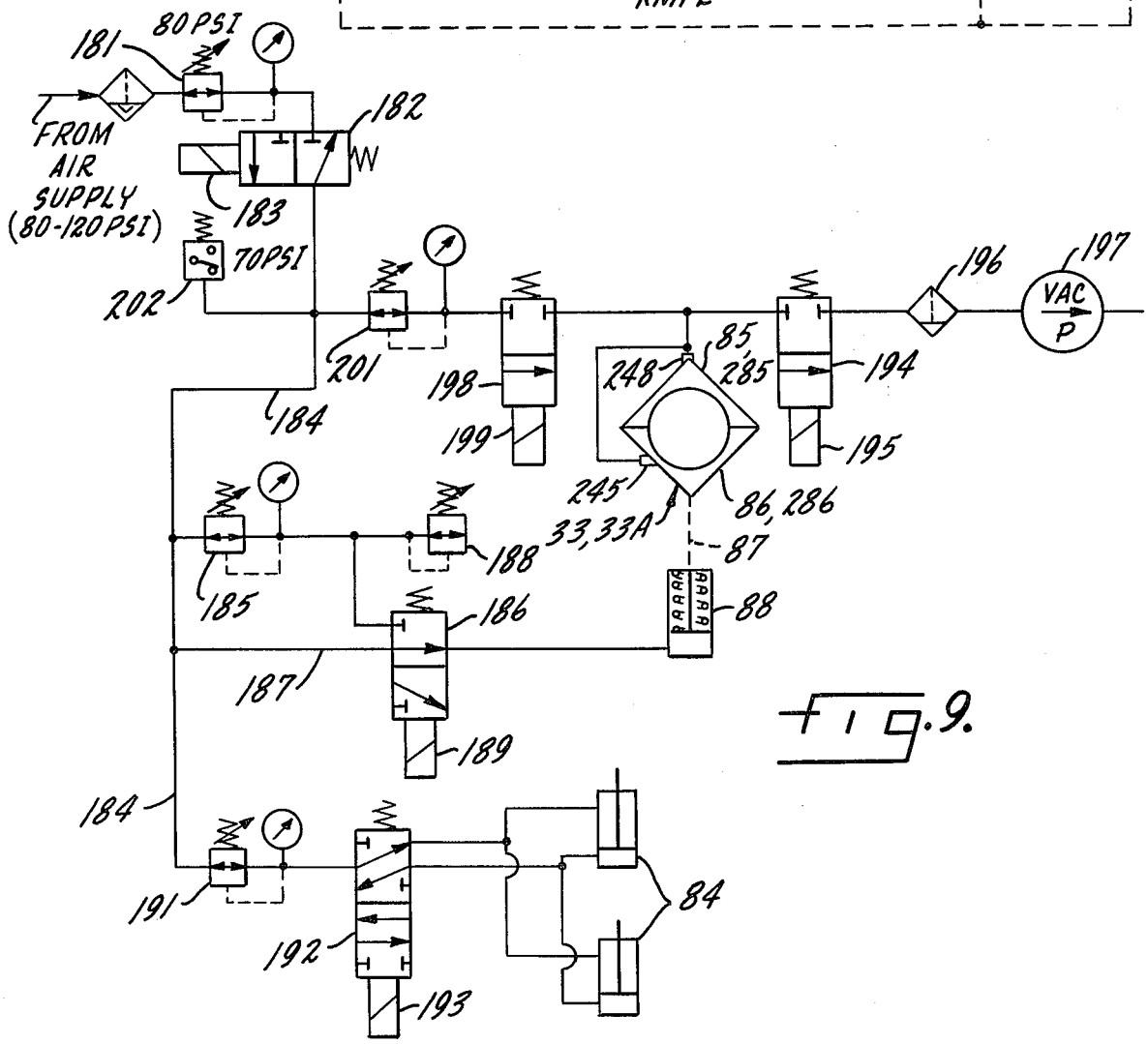
FIG. 9 is a schematic diagram of pneumatic apparatus incorporated in the slicing machine.

As best shown in the sectional detail in the lower right hand corner of FIG. 7, each of the two collar members 285 and 286 is provided with an internal groove 244. A pneumatic fitting 245 is threaded into collar member 285 and communicates with the groove 244 in that member through a small passage 246. A similar pneumatic fitting 247 is mounted in collar member 286 and is connected by a small passage 248 to the internal grooves 244 in that collar member. The pneumatic fittings 245 and 247 are accessible externally of collar assembly 33A and are connected to a vacuum pump (FIG. 9). By drawing a vacuum in the grooves 244, collar 33A affords an effective holding action for the butt end of a loaf while the final portion of that butt end is being sliced. This arrangement is of substantial advantage in assuring that slicing machine 20 obtains as many good slices from each loaf as is possible. Though not shown in the drawings, the same vacuum clamp arrangement is incorporated in the circular collar 33 of FIGS. 4 and 5.

In the collars 33 and 33A shown in FIGS. 4–7, the collar members 85,86 and 285,286 all project an appreciable distance below their support frames 105 and 205; see FIGS. 5 and 7. Thus, the collar members 85,86 of collar 33 afford on exposed lower collar surface 143, and collar 33A provides a similar exposed lower surface 243. These are the collar surfaces that are shaped by knife 35 to conform to the contour of the knife edge and its movement through the slicing station as described above.

Figure 8:
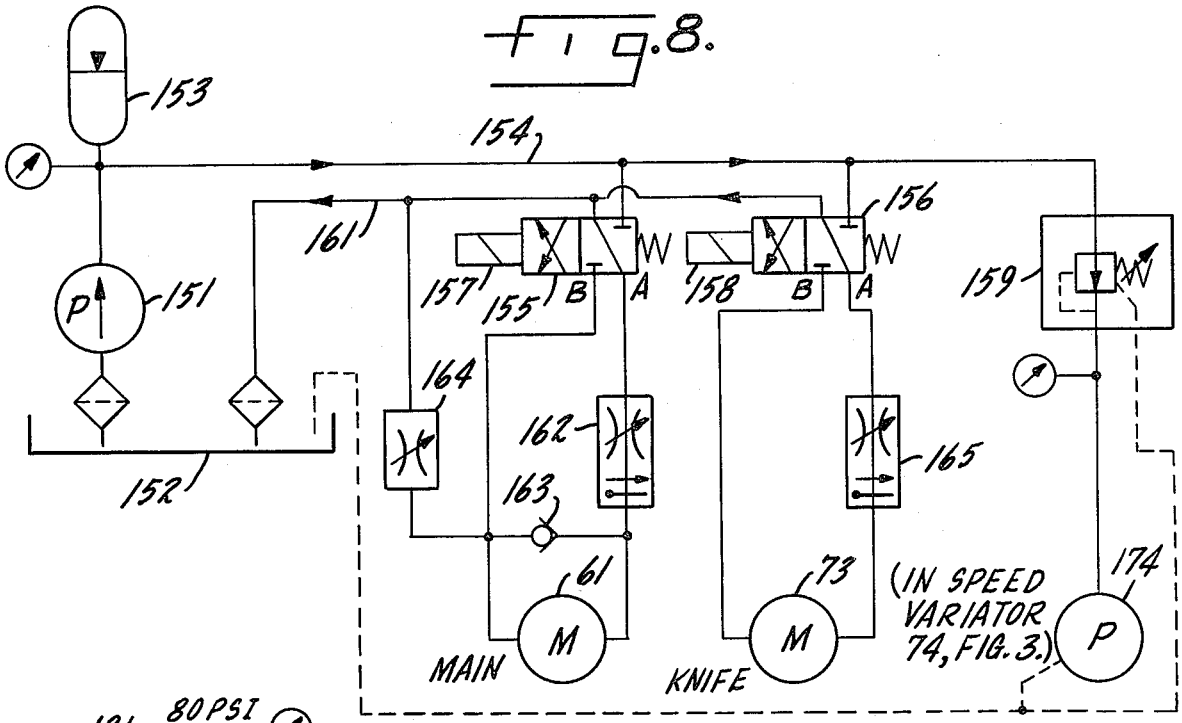
FIG. 8 is a schematic diagram of hydraulic apparatus incorporated in the slicing machine.

FIG. 8 affords a schematic diagram of principal hydraulic apparatus incorporated in slicing machine 20. The hydraulic system shown therein comprises a pump 151 having an input connection to a reservoir or tank 152 and having its output connected to an accumulator 153. A high pressure hydraulic line 154 extends from the outlet of pump 151 and accumulator 153 to two control valves 155 and 156 actuated by two solenoids 157 and 158 respectively. The high pressure hydraulic line 154, which in a typical machine may carry hydraulic fluid at a pressure of 800 pounds per square inch, is also connected to an adjustable pressure reducing valve 159.

Valve 155, which is also connected to a tank return line 161, is the control valve for the main drive motor 61. The inlet of motor 61 is connected to the B port of valve 155. The A port of valve 155 is connected to the outlet of motor 61 through a variable flow controller 162. A cracking check valve 163 is connected across the inlet and outlet of motor 61. In addition, the outlet of motor 61 is returned to the tank or drain line 161 through a second manually adjustable flow controller 164.

Valve 156 is the control valve for knife motor 73. The inlet of motor 73 is connected to the B port of valve 156. The A port of the valve is connected through a variable flow controller 165 to the outlet of the motor.

The adjustable pressure reduction device 159 is connected to the input of a pump 174 that is a principal operating unit of speed variator 74 (see FIG. 3). Appropriate auxiliary drain lines are provided from device 159 and pump 174 back to tank 152.

Operation of the hydraulic apparatus shown in FIG. 8 is quite simple and straightforward. The main drive motor 61 is actuated by energizing solenoid 157 to connect the motor to pressure line 154 and drain line 161 through valve 155. A minimum speed for motor 61 is set by adjustment of flow controller 164. The main speed control for the motor, however, comprises flow controller 162, which is manually operated. Check valve 163 provides a means of decelerating orbiting machine parts driven by main drive motor 61 when solenoid 157 of valve 155 is de-energized.

Similarly, knife motor 73 is energized by operation of solenoid 158 to connect the motor to lines 154 and 161 through valve 156. The operating speed for motor 73 is controlled by the manually operated flow controller 165. Pressure reduction valve 159 functions only to afford a supply of hydraulic fluid, at a controlled pressure, to pump 174.

FIG. 9 affords a schematic representation of basic pneumatic control apparatus for principal functions of slicing machine 20. As shown therein, an external air supply is connected through a pressure reducing valve 181 to a main control valve 182 actuated by a solenoid 183. A main air supply line 184 from valve 182 is connected through a pressure reducing valve 185 to a collar clamp pressure control valve 186. There are two connections from air pressure line 184 to valve 186, one a direct connection 187 and the other the pressure reducing connection through valve 185. A safety valve 188 is also connected to pressure reduction valve 185. Valve 186, which is actuated by a solenoid 189, is connected to the pneumatic cylinder 88 that controls the position of movable collar member 86 in collar 33.

The main pneumatic supply line 184 is also connected through a pressure reducing device 191 to a conveyor position control valve 192 actuated by a solenoid 193. The output ports of valve 193 are connected to the two conveyor position cylinders 84.

The pneumatic connectors 245 and 248 for the vacuum clamp grooves in the two collar members 85 and 86 (or 285 and 286) are connected to a vacuum control valve 194 actuated by a solenoid 195. Valve 194 is connected through a filter 196 to a conventional vacuum pump 197. The vacuum grooves in the collar members are also connected to a purge control valve 198 actuated by a solenoid 199. Valve 198 is also connected to the main pneumatic supply line 184 by a pressure reducing device 201.

When slicing machine 20 is in operation, solenoid 183 is energized to connected the main pneumatic supply line 184 to the external air supply through valve 182 and pressure reduction device 181. In a typical installation, device 181 is set to regulate the pressure in line 184 to eighty psi. A pressure sensing switch 202 connected to line 184 monitors the pressure in line 184 as a safety measure and may be utilized to shut slicing machine 20 down if the pressure falls below seventy psi.

During the initial set-up of slicing machine 20, before the slicing machine comes up to speed, solenoid 189 remains unenergized and valve 186 is in the position shown in FIG. 9. Under these circumstances, full pressure from line 184 is supplied to collar clamp cylinder 88 to maintain effective clamping pressure on the loaf at collar 33 and preclude advance of the loaf through the collar. Subsequently, when the main drive motor 61 is up to speed (see FIGS. 3 and 8), solenoid 189 (FIG. 9) is energized to actuate valve 186 to its alternate position. In these circumstances, the air supply to cylinder 88 is at a reduced pressure determined by the pressure reducing valve 185. That pressure is only sufficient to maintain collar 33 in firm contact with the loaf to assure effective sensing of changes in loaf cross sectional area as described above without unduly inhibiting movement of the loaf through the collar.

With solenoid 193 unenergized, the conveyor clamping pressure control valve 192 is in the position shown in FIG. 9, supplying air at reduced pressure to one end of each of the conveyor position cylinders 84. For this condition, cylinders 84 maintain maximum separation between belt conveyors 31 and 32 (FIG. 3). When slicing machine 20 is in operation, solenoid 193 is energized, reversing the connections to conveyor position cylinders 84. Under these circumstances, the air supply to cylinders 84 actuates those cylinders to move belt conveyor 31 toward conveyor 32 and thus maintain both of the loaf feed conveyor belts in firm contact with the food loaf 27.

When the butt end of a loaf being sliced approaches collar 33 (or 33A), solenoid 199 is energized for a brief interval. In consequence, air is introduced into the vacuum grooves in the collar members, effectively purging those grooves of any accumulated material. Subsequently, solenoid 199 is de-energized, ending the purge interval, and solenoid 195 is energized to actuate valve 194, connecting the vacuum grooves of the collar members to vacuum pump 197. The vacuum thus drawn in the collar member grooves prevents the butt end of the loaf from falling out of the collar but allows it to continue to advance responsive to the impetus provided by the lead end of a succeeding loaf. Thus, the vacuum arrangement for the loaf feed collar assures maximum production of consistent slices from the butt end of each loaf.

We claim:

1. In a high volume food loaf slicing machine of the kind comprising:

a loaf support, supporting a food loaf for movement along a downwardly inclined path;

loaf feed conveyor means, positioned at the lower end of the food loaf path, for continuously advancing a food loaf along that path and into a slicing station;

and a rotory knife, supported for orbital movement into and out of the slicing station in a direction transverse to the food loaf path, for cyclically cutting individual slices from the loaf as the loaf enters the slicing station;

the improvement comprising:

variable speed main drive motor means;

knife orbit drive connection means, connecting the main drive motor means to the knife to drive the knife through its orbital movement at a slicing rate determined by the speed of the main drive motor means;

conveyor drive connection means, connecting the main drive motor means to the loaf feed conveyor means to drive the conveyor means at a loaf feed rate determined in part by the speed of the main drive motor means;

variable speed knife rotation motor means, connected to the knife to drive the knife through its rotary motion at a cutting rate determined by the speed of the knife rotation motor means and independent of the speed of the main drive motor means;

a collar encompassing the loaf at the entrance to the slicing station, the collar being of transverse split construction, including first and second collar members, one collar member being movable toward and away from the other in a direction transverse to the food loaf path;

collar closure means, connected to the one collar member, for biasing the movable collar member toward the other collar member to maintain both collar members in predetermined limited pressure engagement with the lowermost end of the feed loaf but permitting continuous movement of the loaf through the collar;

a loaf size sensor, connected to the one collar member, for sensing movements of the one collar member indicative of variations in cross-sectional area of the loaf;

and control means, connected to the loaf size sensor, for actuating the conveyor drive connection means to vary the loaf feed conveyor speed to compensate for changes in loaf cross-sectional area.

2. The food loaf slicing machine of claim 1 in which the collar closure means includes means to apply a high pressure to the movable collar member to clamp the lowermost end of the loaf in the collar and preclude further movement of the food loaf into the slicing station.

3. The food loaf slicing machine of claim 1 in which the collar member are formed of a molded machinable resin and are cut by the knife to conform to the cutting path followed by the knife edge moving through the slicing station.

4. The food loaf slicing machine of claim 1 in which each collar member includes an elongated groove facing the interior of the collar;

and a vacuum pump connected to the collar grooves, whereby the vacuum grooves assist in retaining a loaf end in the collar after the loaf end has moved beyond the loaf feed conveyor means.

5. The food loaf slicing machine of claim 1 in which the loaf feed conveyor means comprises:

two belt conveyors, located on opposite sides of the food loaf path;

conveyor shift means, connected to at least one of the belt conveyors, for moving the belt conveyors relative to each other to positively grip the feed loaf moving along the feed loaf path;

and collar shift means for shifting the collar through a limited range of positions in a direction transverse to the food loaf path.

6. The food loaf slicing machine of claim 1 in which the conveyor drive connection means includes speed variation means for varying the speed of the loaf speed conveyor means over a substantial, continuous speed range to vary the loaf feed rate relative to the slicing rate of the slicing machine and thereby vary the thickness of slices cut by the slicing machine.

7. The food loaf slicing machine of claim 1, further comprising:

a loaf end sensor for sensing the upper end of a loaf moving into the loaf feed conveyor means.

8. The food loaf slicing machine of claim 1 in which the orbital axis of the knife is inclined at a very small angle relative to the rotary axis of the knife to minimize scrubbing of the knife against the surface of the food loaf in the latter part of the cutting of a slice from the loaf.

9. In a high volume food loaf slicing machine of the kind comprising:

a loaf support, supporting a food loaf for movement along a downwardly inclined path;

loaf feed conveyor means, positioned at the lower end of the food loaf path, for continuously advancing a food loaf along that path and into a slicing station;

a rotary knife, supported for orbital movement into and out of the slicing station in a direction transverse to the food loaf path, for cyclically cutting individual slices from the loaf as the loaf enters the slicing station;

variable speed knife orbit drive means for driving the knife through its orbital movement at a predetermined slicing rate;

variable speed conveyor drive means for driving the conveyor means at a predetermined loaf feed rate;

and variable speed knife rotation drive means for driving the knife through its rotary motion at a predetermined cutting rate;

the improvement comprising:

a collar encompassing the loaf at the entrance to the slicing station, the collar being of transverse split construction, including first and second collar members, one collar member being movable toward and away from the other in a direction transverse to the food loaf path;

collar closure means, connected to the one collar member, for biasing the movable collar member toward the other collar member to maintain both collar members in predetermined limited pressure engagement with the lowermost end of the feed loaf but permitting continuous movement of the loaf through the collar;

a loaf size sensor, connected to the one collar member, for sensing movements of the one collar member indicative of variations in cross-sectional area of the loaf;

and control means connected to the loaf size sensor, for actuating the conveyor drive means to vary the loaf feed conveyor speed to compensate for changes in loaf cross-sectional area.

10. The food loaf slicing machine of claim 9 in which the collar closure means includes means to apply a high pressure to the movable collar member to clamp the lowermost end of the loaf in the collar and preclude further movement of the food loaf into the slicing station.

11. The food loaf slicing machine of claim 9 in which the collar members are formed of a molded machinable resin and are cut by the knife to conform to the cutting path followed by the knife edge moving through the slicing station.

12. The food loaf slicing machine of claim 9 in which each collar member includes an elongated groove facing the interior of the collar;

and a vacuum pump connected to the collar grooves, whereby the vacuum grooves assist in retaining a loaf end in the collar after the loaf end has moved beyond the loaf feed conveyor means.

13. The food loaf slicing machine of claim 9 in which the loaf feed conveyor means comprises:

two belt conveyors, located on opposite sides of the food loaf path;

conveyor shift means, connected to at least one of the belt conveyors, for moving the belt conveyors relative to each other to positively grip the feed loaf moving along the feed loaf path;

and collar shift means for shifting the collar through a limited range of positions in a direction transverse to the food loaf path.

14. The food loaf slicing machine of claim 9 in which the conveyor drive means includes speed variation means for varying the speed of the loaf speed conveyor means over a substantial, continuous speed range to vary the loaf feed rate relative to the slicing rate of the machine and thereby vary the thickness of slices cut by the slicing machine.

15. The food loaf slicing machine of claim 9, further comprising:

a loaf end sensor for sensing the upper end of a loaf moving into the loaf feed conveyor means.

16. The food loaf slicing machine of claim 9, claim 11, claim 12, or claim 13 in which the orbital axis of the knife is inclined at a very small angle relative to the rotary axis of the knife to minimize scrubbing of the knife against the surface of the food loaf in the latter part of the cutting of a slice from the loaf.

17. In a high volume food loaf slicing machine of the kind comprising:

a loaf support, supporting a food loaf for movement along a downwardly inclined path;

loaf feed conveyor means, positioned at the lower end of the food loaf path, for continuously advancing a food loaf along that path and into a slicing station;

a rotary knife, supported for orbital movement into and out of the slicing station in a direction transverse to the food loaf path, for cyclically cutting individual slices from the loaf as the loaf enters the slicing station;

variable speed knife orbit drive means for driving the knife through its orbital movement at a predetermined slicing rate;

variable speed conveyor drive means for driving the conveyor means at a predetermined loaf feed rate;

and variable speed knife rotation drive means for driving the knife through its rotary motion at a predetermined cutting rate;

the improvement comprising:

a collar encompassing the loaf at the entrance to the slicing station, the collar being of transverse split construction, including first and second collar members, one collar member being movable toward and away from the other in a direction transverse to the food loaf path; and collar closure means, connected to the one collar member, for biasing the movable collar member toward the other collar member to maintain both collar members in predetermined limited pressure engagement with the lowermost end of the feed loaf but permitting continuous movement of the loaf through the collar;

the collar closure means further including means to apply a high pressure to the movable collar member to clamp the lowermost end of the loaf in the collar and preclude further movement of the food loaf into the slicing station.

18. The food loaf slicing machine of claim 17 in which the collar members are formed of a molded machinable resin and are cut by the knife to conform to the cutting path followed by the knife edge moving through the slicing station.

19. The food loaf slicing machine of claim 17 or claim 18 in which each collar member includes an elongated groove facing the interior of the collar;

and a vacuum pump connected to the collar grooves, whereby the vacuum grooves assist in retaining a loaf end in the collar after the loaf end has moved beyond the loaf feed conveyor means.

20. The food loaf slicing machine of claim 17 or claim 18 in which the loaf feed conveyor means comprises:

two belt conveyors, located on opposite sides of the food loaf path;

conveyor shift means, connected to at least one of the belt conveyors, for moving the belt conveyors relative to each other to positively grip the feed loaf moving along the feed loaf path;

and collar shift means for shifting the collar through a limited ranged of positions in a direction transverse to the food loaf path.

21. The food loaf slicing machine of claim 17 or claim 18 in which the conveyor drive means includes speed variation means for varying the speed of the loaf speed conveyor means over a substantial, continuous speed range to vary the loaf feed rate relative to the slicing rate of the machine and thereby vary the thickness of slices cut by the slicing machine, and in which the knife rotation drive means is independent of the knife orbit drive means.

* * * * *